United States Patent [19]

Newman

[11] 4,214,665

[45] Jul. 29, 1980

[54] TRUCK MOUNTED RAILROAD CRANE BOOM SECTION

[76] Inventor: Timothy L. Newman, 700 N. Liberty, Jerseyville, Ill. 62050

[21] Appl. No.: 911,627

[22] Filed: Jun. 1, 1978

[51] Int. Cl.[2] ..... B66C 23/06

[52] U.S. Cl. ..... 52/726; 105/215 C; 52/720; 212/177

[58] Field of Search ..... 105/215 C; 212/144; 52/114

[56] References Cited

U.S. PATENT DOCUMENTS

| | | | |
|---|---|---|---|
| 2,053,157 | 9/1936 | Ljungkull | 212/144 |
| 3,187,906 | 6/1965 | Bushong et al. | 212/144 |
| 3,263,628 | 8/1966 | Grove et al. | 105/215 C |
| 3,269,331 | 8/1966 | Thompson | 105/215 C |
| 3,323,660 | 6/1967 | Allin, Sr. | 212/144 |
| 3,581,671 | 6/1971 | Hart | 105/215 C |
| 3,759,399 | 9/1973 | Glass et al. | 212/144 |

*Primary Examiner*—Richard A. Bertsch
*Attorney, Agent, or Firm*—Michael Kovac

[57] ABSTRACT

A crane boom section for a crane boom superstructure on a truck mounted railroad crane or the like is disclosed as including an enclosed exterior with spaced inner cross brace supports preventing twisting or bending of the crane boom section when subjected to heavy loads and stresses.

5 Claims, 10 Drawing Figures

TRUCK MOUNTED RAILROAD CRANE BOOM SECTION

SUMMARY OF THE INVENTION

This application is related to my following copending patent applications: Ser. No. 911,597 filed June 1, 1978 entitled "TRUCK MOUNTED RAILROAD CRANE MAIN BED FRAME", Ser. No. 911,637 filed June 1, 1978 entitled "TRUCK MOUNTED RAILROAD CRANE RAILGEAR ASSEMBLY;" and Ser. No. 911,638 filed June 1, 1978 entitled "TRUCK MOUNTED RAILROAD CRANE HYDRAULIC SWIVEL MEANS."

The present invention is in the field of truck mounted railroad cranes which are convertible highway/railway vehicles capable of highway travel on a truck chassis, as well as being convertible for travel on train rails through extensible front and rear train rail gear, which guide the vehicle on train tracks, while allowing the rubber wheels of the vehicle to move the vehicle to the desired location. Such vehicles are principally used for train derailments, although they are useful for other train and rail construction and maintenance operations.

At the site of a train derailment, the truck mounted railroad crane, which has previously been driven as a truck over highways and then positioned on at adjacent tracks leading to the train derailment, is ready to re-position de-railed train cars back onto tracks from which they have become derailed. This is achieved through the swiveling crane boom also mounted on the truck chassis. The operator of the truck mounted railroad crane positions himself in the crane cab to operate the crane controls that raise, lower and swing the crane boom for re-positioning the de-railed railcar back on train rails.

Truck mounted railroad cranes are thus versatile pieces of equipment that require both highway and railway travel, as well as operation and control of crane booms. As will also be appreciated, such vehicles must withstand vigorous conditions encountered in transporting same and in operating the crane.

One of the major problems encountered in truck mounted railroad cranes relates to the crane boom. As will be appreciated, crane booms are subjected to extremely heavy loads and torsional stresses in serving as the main structural member for raising, lowering and swinging rail cars to the desired position. Most of the crane booms presently used with truck mounted railroad cranes include an open network of overlapping crossbar elements such as shown in U.S. Pat. Nos. 2,975,910 and 3,306,470. With some frequency, crane booms of this design are not able to withstand the heavy loads and stresses to which they are subjected, and the crane boom becomes twisted or bent, requiring repair thereof. Where twisting or bending occurs, it normally takes place in a particular area of the crane boom; however, the design of most crane booms requires the entire boom to be returned to the repair shop for maintenance and repair.

Accordingly, the present invention is directed to a new and improved crane boom for a truck mounted railroad crane or the like that overcomes the aforementioned deficiences of prior art designs.

More specifically, the principal object of the present invention is to provide a structurally interconnected crane boom that withstands heavy loads and stresses while facilitating repair or replacement of the entire boom section.

These and other objects and advantages will become more apparent from the ensuing description.

DESCRIPTION OF THE PREFERRED EMBODIMENTS

Figure 1:
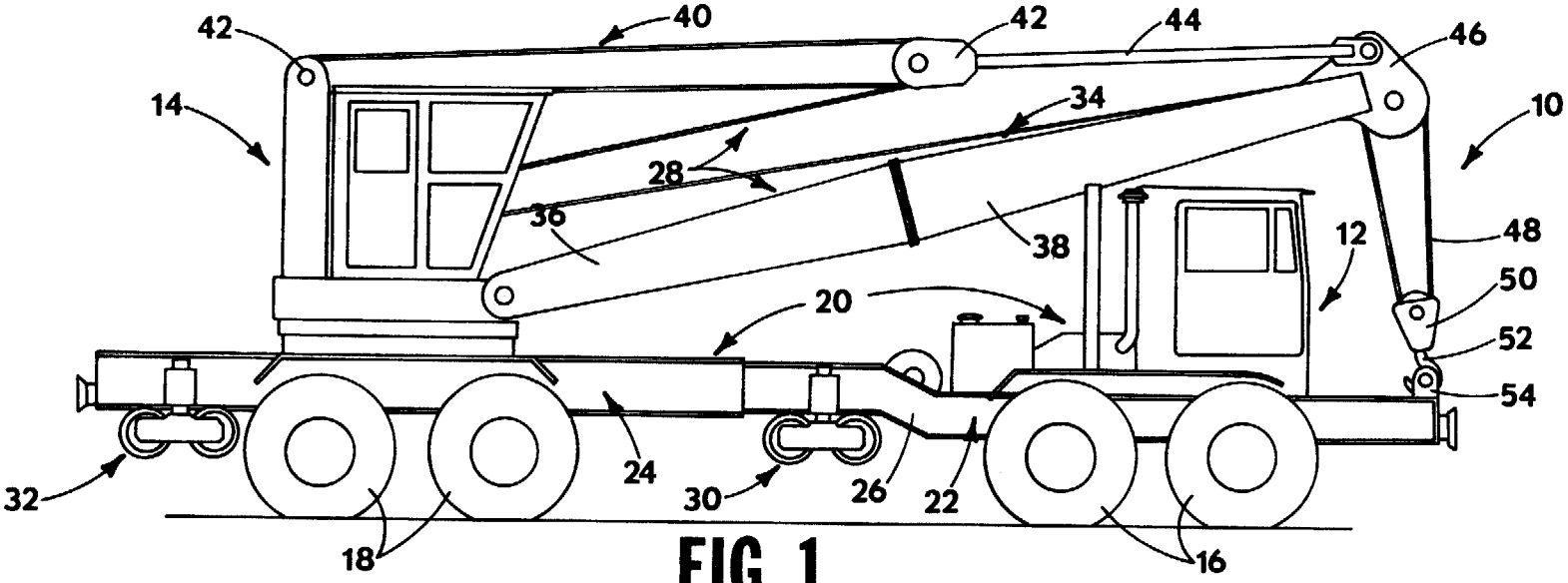
FIG. 1 is a side elevational view of a truck mounted railroad crane, including my new crane boom section, which is constructed in accordance with the teachings of the present invention.
Figure 2:
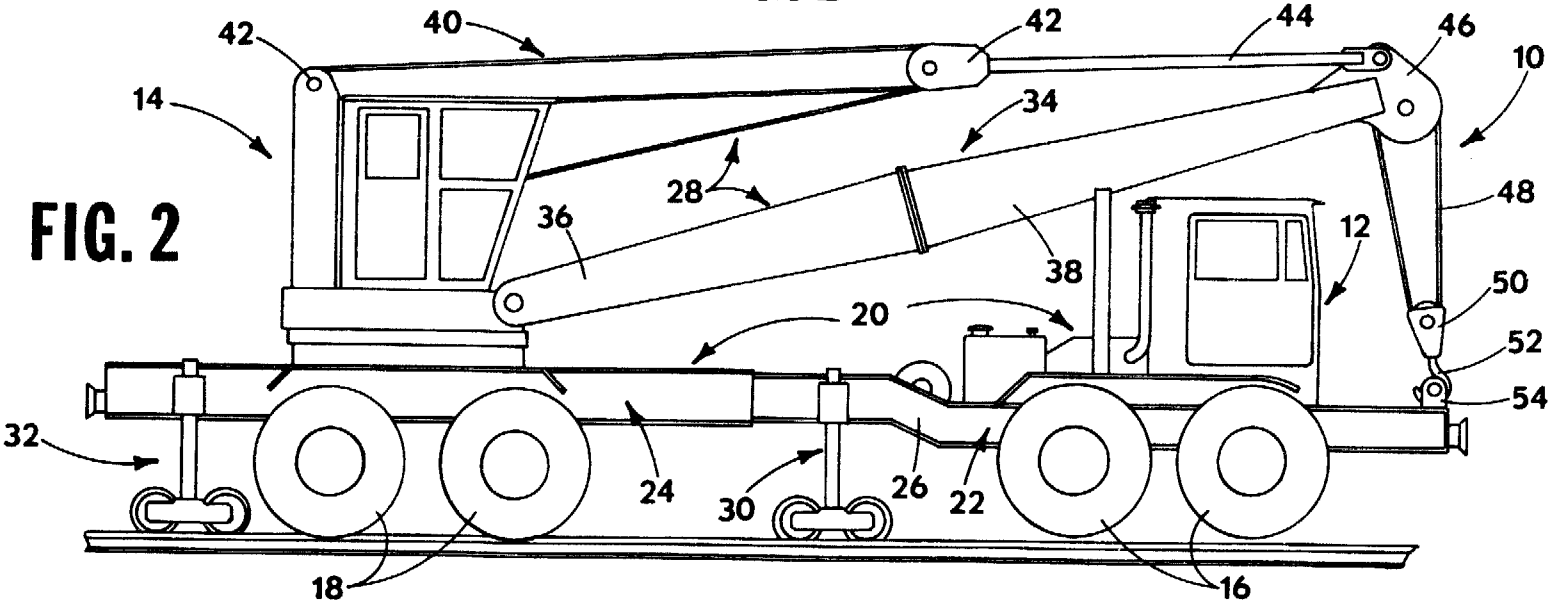
FIG. 2 is a side elevational view, similar to FIG. 1, but showing the truck mounted railroad crane convertible for travel on train rails.
Figure 3:
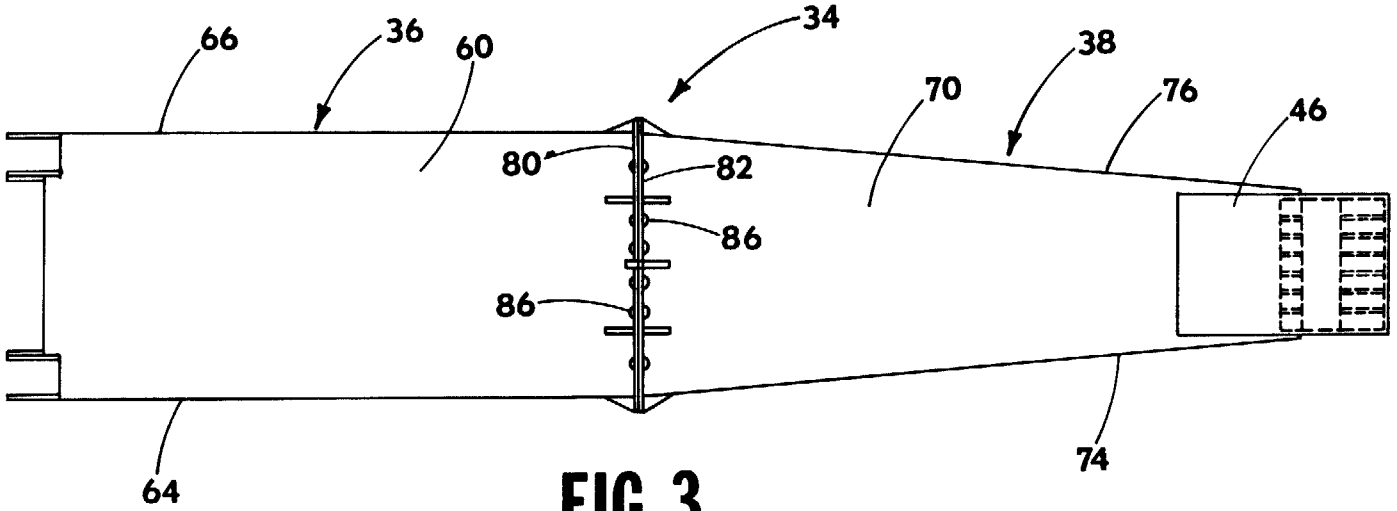
FIG. 3 is a top plan view of the crane boom section of my invention.

FIGS. 1 and 2 of the drawings show my preferred design of truck mounted railroad crane 10 which includes a truck cab 12 at the front end and a crane cab 14 at the rear end. The truck cab 12 is mounted over the front pneumatic rubber tires 16 while the crane cab 14 is mounted over the rear pneumatic rubber tires 18. The truck cab 12 and crane cab 14 are interconnected through the vehicle frame 20 that includes a truck chassis frame 22 and crane bed frame 24. It will be seen that the truck chassis frame 22 is mounted lower than crane bed frame 24 through the angular interconnecting frame structure 26. There are several reasons for this including maintaining the crane boom superstructure 28 at the lowest possible height when traveling over highways, as shown in FIG. 1, while enabling the truck cab 12, frame 22 and tires 16 to be lifted off the railroad tracks, as shown in FIG. 2, to allow transporting of the truck mounted railroad crane 10 to the desired location over railroad tracks.

This lifting of the truck cab 12, frame 22 and tires 16 at the front end of the truck mounted railroad crane 10 is achieved by the front and rear train gear 30, 32 that are mounted on the crane bed frame. As seen in FIG. 1, the front and rear train rail gear 30, 32 respectively are maintained in a retracted position to allow the front and rear pneumatic rubber tires 16, 18 respectively to move the truck mounted railroad crane 10 over highways. However, when the desired train rail location has been reached, the truck mounted railroad crane 10 is driven into a straddle position over train rails, and the front and rear train rail gears 30, 32 respectively are lowered or extended to raise the truck cab 12, truck chassis frame 22 and front pneumatic rubber tires 16 off of the railroad tracks. This enables the front and rear train gears 30, 32 respectively to guide the truck mounted railroad crane 10 over train rails, while allowing inside pairs of wheels (not shown) of the rear pneumatic rubber tires 18 to rest upon and engage the train rails. In this way, the truck mounted railroad crane 12 is transported over train rails by the driven rear pneumatic rubber tires 18 of the truck mounted railroad crane 10.

When the truck mounted railroad crane 10 reaches the desired location, such as a train derailment train rail construction, train rail maintenance operation or the like, the crane boom superstructure 28 may then be put into operation to raise, lower and swing train cars and the like, as may be desired. The crane boom superstructure 28 includes a boom 34 that is hingedly mounted to the crane cab 14 for raising and lowering of the boom 34, as well as for swiveling or rotational movement of the crane cab 14 and associated boom 34 relative to the crane bed frame 24. The boom 34 comprises two sections, an inboard section 36 and an outboard section 38. The inboard section 36 is pivotally or hingedly attached to the crane cab 14 while the outboard section 38 is supported and its angular position controlled by means of the hoisting cables 14 reeved through suitable hoisting cable sheever 42 and the connecting link 44 that extends between the outermost sheeve 42 and the fixed block sheeve 46 mounted at the free end of the outboard section 38. The fixed block sheeve 46 threadably carried a lift cable 48 which is also threaded over a load engaging block 50 that includes a hook 52. When not in use, the hook 52 is restrained by the shaft block 54 mounted at the front of the truck chassis frame 22, as seen in FIGS. 1 and 2.

Referring now more particularly to the construction of the crane boom 34, including inboard section 36 and outboard section 38, attention is directed to FIGS. 3–6 of the drawings where the specific structural components of the crane boom 34 are illustrated.

Both the inboard section 36 and the outboard section 38 are shown as being provided with an enclosed exterior wall construction that is of generally rectangular cross sectional configuration. The enclosed exterior wall construction of the inboard section 36 defined by upper wall portion 60, bottom wall portion 62, and opposite side wall portions 64, 66. The enclosed exterior wall construction of the outboard section 38 is defined by upper wall portion 70, bottom wall portion 72, and opposite side wall portions 74, 76.

Figure 6C:
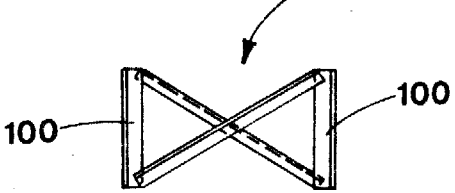
FIGS. 6A, 6B, 6C, 6D and 6E are end elevational views of the inner and connecting components of the crane boom section.
Figure 6D:
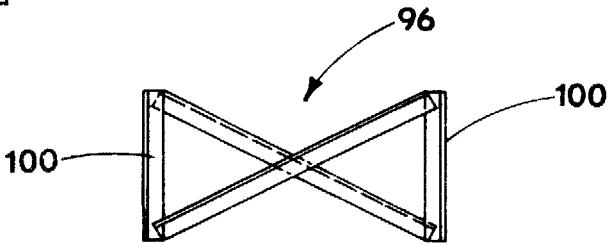
Figure 6E:
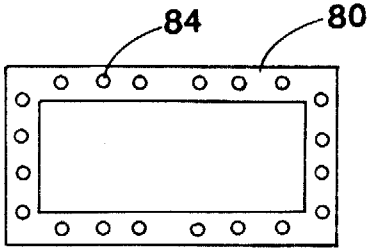
Figure 6A:
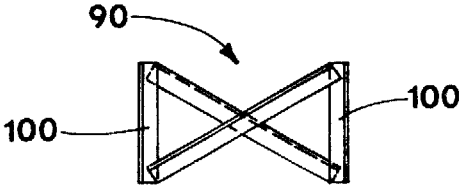
Figure 6B:
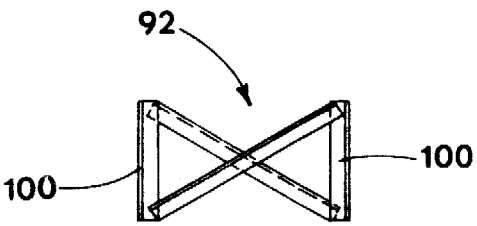

The inboard section 36 and outboard section 38 are releasably interconnected at one end thereof by way of the complementary flange plates 80, 82 which are welded to the enclosed exterior walls of the inboard section 36 and outboard section 38. The flange plates 80, 82 are identical in size and shape, and a representative illustration is shown in FIG. 6E of the drawings. It will be seen in FIG. 6E that spaced openings 84 are formed in the flange plates 80, 82 for receiving suitable fastening means, such as the complementary nut and bolt means 86 shown in FIGS. 3–4.

Thus in the event of twisting or bending the inboard section 36 or outboard section 38, they may be releasably unfastened relative to one another to permit the twisted or bent section to be returned to the repair shop for maintenance or repair thereof.

In order to prevent or restrain twisting or bending of the inboard section 36 and outboard section 38, the present invention incorporates several important features, as will now be discussed.

Figure 5:
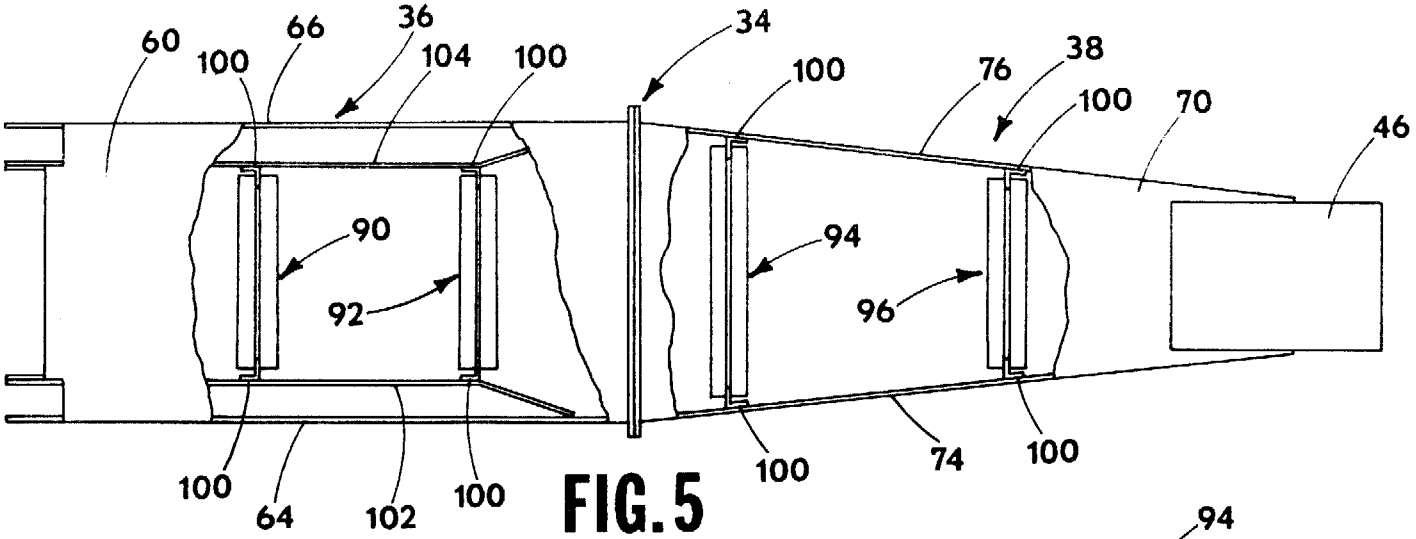
FIG. 5 is a fragmentary top plan view of my crane boom section showing the inner components thereof.

In conjunction with the enclosed exterior wall constructions of both the inboard section 36 and the outboard section 38 of the boom 34, it will be seen in FIG. 5 that each boom section is provided with spaced cross brace elements which are identified as 90, 92 with inboard section 36 and 94, 96 with outboard section 38. End elevational views of the cross brace elements 90, 92, 94 and 96 are shown in FIGS. 6A, 6B, 6C and 6D of the drawings for structural rigidity, each of the cross brace elements 90, 92, 94 and 96 have an L-shaped cross sectional configuration. Also, the outer free ends of the cross brace elements 90, 92, 94 and 96 are interconnected to one another through the interconnecting struts 100.

Each of the cross brace elements 90, 92, 94 and 96 are arranged to be structurally interconnected with the enclosed exterior wall constructions of the inboard section 36 and outboard section 38. More specifically, it will be seen in FIG. 5 that the interconnecting struts 100 of the cross brace elements 90, 92, associated with the inboard section 36, are arranged to engage elongated reinforcing members 102, 104 mounted to opposite inner side wall surfaces of side wall portions 64, 66 respectively. With regard to cross brace elements 94, 96, it will be seen in FIG. 5 that the interconnecting struts 100 of the cross brace elements 94, 96 directly engage opposite inner side surfaces of the opposite side wall portions 74, 76 of the enclosed exterior wall. Thus, twisting or bending is restrained or prevented by the aforementioned structural interconnection of components.

Figure 4:
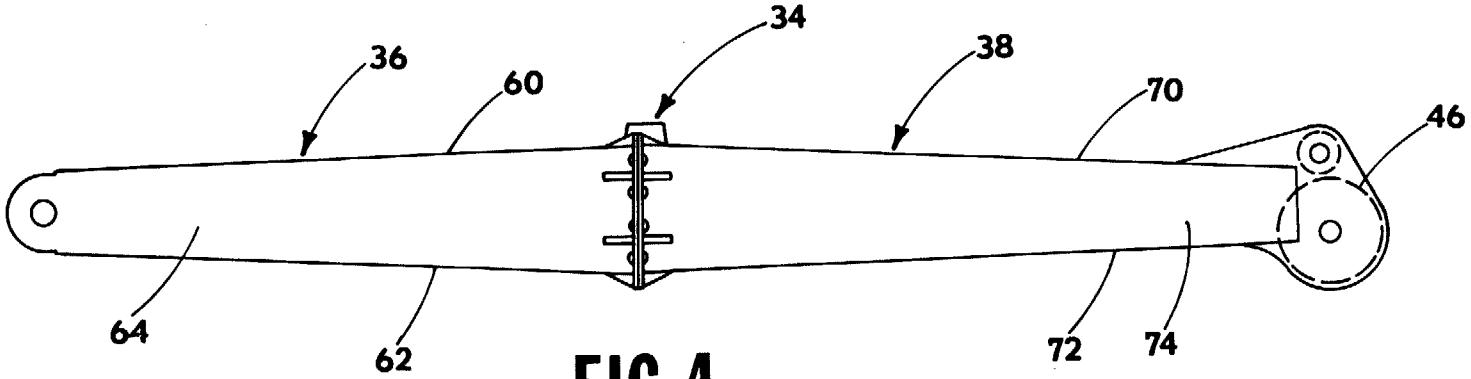
FIG. 4 is a side elevational view of the crane boom section showin FIG. 3.

To further assist in restraining of preventing twisting or bending of the inboard section 36 and outboard section 38, it will be seen from FIG. 4 that both the upper and bottom wall portions 60, 62 of the inboard section 36 and 70, 72 of the outboard section 38 taper inwardly from the connected ends thereof to the opposite ends thereof. Also, the outboard section 38 has the opposite side wall portions 74, 76 tapering inwardly from the connected ends of the inboard and outboard sections 36, 38 to the opposite end thereof. As will be understood, the tapered configuration of the inboard and outboard sections 36, 38, together with the cross brace elements 90, 92, 94 and 96, restrain or limit twisting or bending of the crane boom sections.

From the foregoing, it will be appreciated that the inboard and outboard sections of the crane boom assembly, when subjected to great stresses and loads are limited or restrained against twisting or bending movement of the crane boom sections, and even when damaged, the damaged crane boom section may be separated from the undamaged section for maintenance and repair of the damaged section, without removing or transporting the undamaged section.

I claim:

1. A crane boom assembly for use with a crane boom superstructure in a railroad vehicle or the like, comprising two elongated boom sections, each boom section having an enclosed exterior wall with at least two spaced cross brace elements extending substantially normal to the elongated construction of each boom section, each cross brace element having a L-shaped cross sectional shape with each cooperating pair of cross brace elements having an X-shaped configuration, interconnecting strut means extending between the free ends of the X-shaped cross brace elements, and each of said X-shaped cross brace elements contacting the inner surface of the enclosed exterior wall through the interconnecting strut means in order to support each boom section against twisting or bending thereof along the elongated construction thereof.

2. The crane boom assembly as defined in claim 1 wherein the interconnecting struts of the X-shaped cross brace elements engage opposite inner side surfaces of the enclosed exterior wall.

3. The crane boom assembly as defined in claim 1 wherein the interconnecting struts of the X-shaped cross brace elements engage elongated reinforcing members mounted to opposite inner side surfaces of the enclosed exterior wall.

4. The crane boom assembly as defined in claim 1 wherein the two elongated boom sections include an inboard section and an outboard section, said inboard and outboard sections being releasably interconnected to one another at one end of each boom section.

5. The crane boom assembly as defined in claim 4 wherein each boom section has a rectangular cross sectional configuration defining upper, bottom and opposite side wall portions for the enclosed exterior wall, the upper and bottom wall portions of each boom section tapering toward each other from the interconnected ends of each boom section to the other ends thereof, and the opposite side wall portions of the outboard section of said crane boom assembly also tapering toward each other from the interconnected ends of each boom section to the other end thereof.

* * * * *